United States Patent [19]

Lovell et al.

[11] 4,023,266

[45] May 17, 1977

[54] PROCESS FOR PREPARING LIQUID METAL ELECTRICAL CONTACT DEVICE

[75] Inventors: Robert R. Lovell, N. Ridgeville; Frank D. Berkopec, Fairview Park; David H. Culp, Rocky River, all of Ohio

[73] Assignee: The United States of America as represented by the Administrator of the National Aeronautics and Space Administration, Washington, D.C.

[22] Filed: July 26, 1976

[21] Appl. No.: 708,658

[52] U.S. Cl. ..... 29/628; 29/597; 29/622; 29/630 E; 204/32 R

[51] Int. Cl.[2] ..... H01R 43/00

[58] Field of Search ..... 29/628, 630 E, 630 R, 29/622, 597, 527.1, 527.2, 530; 310/231, 232, 242, 248, 249, 251, 252; 200/262, 270, 230, 231, 232, 233, 234, 235; 204/32 R, 33, 34, 323, 35; 156/2, 5, 6, 18, 20

[56] References Cited

UNITED STATES PATENTS

| | | | |
|---|---|---|---|
| 3,144,533 | 8/1964 | Donath | 200/234 X |
| 3,369,094 | 2/1968 | Langberg et al. | 200/233 X |
| 3,444,408 | 5/1969 | Krulls | 310/232 X |
| 3,497,426 | 2/1970 | Okamura | 204/32 R |
| 3,616,285 | 10/1971 | Norris | 204/32 R X |
| 3,909,569 | 9/1975 | Jones | 200/61.53 |
| 3,966,570 | 6/1976 | Yamagishi et al. | 204/35 R X |

*Primary Examiner*—James R. Duzan
*Attorney, Agent, or Firm*—N. T. Musial; G. E. Shook; John R. Manning

[57] ABSTRACT

In a process or method according to the invention the parts of an electrical contact device, such as a slip ring comprising the ring to receive the liquid metal and the probe or brush for contacting the liquid metal are treated by sputter etching to remove the parent metal oxide. Prior to exposure of the electrodes to any oxygen, a sacrificial metal is sputter deposited on the parts. Preferably this sacrificial metal is one that oxidizes slowly and is readily dissolved by the liquid metal. The sacrificial metal may then be removed from unwanted areas. The remainder of the ring and the probe to be wet by the liquid metal are submerged in the liquid metal or the liquid metal is flushed over these areas, preferably while they are being slightly abraded, until all the sacrificial material on these portions is wet by the liquid metal. In doing so the liquid metal dissolves the sacrificial metal and permanently wets the parent metal. Preferred materials used in the process and for the electrodes of electrical contact devices are high purity (99.0%) nickel or AISI type 304 stainless steel for the electrical contact devices, gallium as the liquid metal, and gold as the sacrificial material.

7 Claims, 1 Drawing Figure

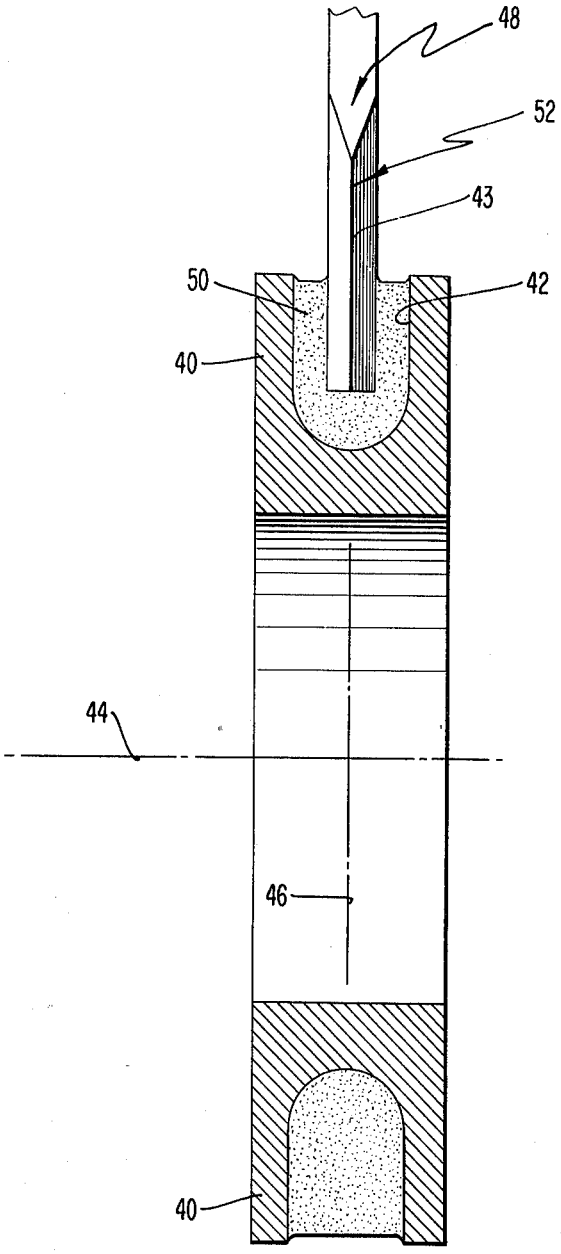
48
52
43
50
42
40
44
46
40

PROCESS FOR PREPARING LIQUID METAL ELECTRICAL CONTACT DEVICE

ORIGIN OF THE INVENTION

The invention described herein was made by employees of the United States government and may be manufactured and used by or for the government for governmental purposes without the payment of any royalties thereon or therefor.

BACKGROUND OF THE INVENTION

It is known to provide electrical contact devices such as slip ring arrangements for use particularly in space on satellites. For example, such a slip ring arrangement may involve a ring which contains a groove which acts as a reservoir for a metal which is liquid during operation and retained in the groove by surface tension. A probe which acts as a brush for the slip ring arrangement is immersed in the liquid metal and thereby makes electrical contact between the probe and the ring. One of the problems in preparing liquid metal electrical contact devices is to apply the charge of liquid metal in such a way that it wets the electrodes thereby making good electrical contact with it.

Prior methods of wetting are based generally upon means whether mechanical or chemical to remove the non-wetting oxide of the metals of which the slip ring and probe or brush are made, from the portions to be wet by the liquid metal. Failure to do so may sometimes cause the liquid metal falsely to wet an oxide or hydrated oxide layer of the liquid metal on such portions over the parent metal of the electrode. Such false wetting tends to dewet in a vacuum environment and result in undesirable operation such as poor or erratic contacts. For example, a mechanical means of oxide removal and liquid metal wetting consists of machining the final configuration while the surfaces are submerged in gallium or in an inert atmosphere. This may be done with a cutting tool, or using a hand-held material with some abrasive properties. It is difficult if not impossible to avoid undesirable impregnation of the electrode with impurities when using such a process.

Chemical means of oxide removal may consist of acid removal of the parent metal oxide or heating those parts of the liquid metal contacting surfaces in vacuum or in an inert atmosphere to a temperature which will drive off the oxide. Then the surfaces must be kept from exposure to any oxygen-containing atmosphere prior to being wet by the liquid metal.

Both the mechanical and chemical methods described above preclude wetting the electrodes or slip ring parts after assembly because the lead-in wires and insulation materials are generally destroyed in the process.

When using the mechanical methods it is difficult to keep the gallium or liquid metal in contact with the cutting tool and the slip ring or brush and also results in troublesome chips and requires relatively large amounts of liquid metal. These mechanical methods do not lend themselves readily for use with any except simple shapes. The mechanical methods are therefore relatively difficult in procedures and require considerable preparatory effort and also are costly in terms of a required amount of liquid metal.

The chemical means of oxide removal also involve assuring that the parent metal be in contact with the liquid metal prior to exposure to oxygen-containing atmosphere. This requirements demands a facility or apparatus such as a dry box or vacuum chamber and further apparatus to apply the liquid metal. In addition, precautions must be taken to be sure that the parent metal is wet in the desired portions only, otherwise additional effort is needed to remove excess liquid metal from contact with undesired areas.

SUMMARY OF THE INVENTION

According to the invention a process of preparing the electrically contacting portions of relatively moveable members, such as a slip ring comprises sputter etching the parts between which electrical contact is to be made, sputter depositing these parts with a sacrificial material, and then wetting the parts with a liquid metal that dissolves the sacrificial material. Thus the liquid metal dissolves the sacrificial material and at the same time wets the parts between which the electrical contact through the intermediary of the liquid metal is to be made.

BRIEF DESCRIPTION OF THE DRAWING

The foregoing and other advantages and novel features of the invention and the objects thereof will be more fully understood from the following brief description when read in connection with the accompanying drawing consisting of a sole FIGURE illustrating a slip ring which may be treated in accordance with the invention.

DESCRIPTION OF THE PREFERRED EMBODIMENT

An example of the process of the invention may be described in connection with the slip ring arrangement illustrated in cross-sectional view in the sole FIGURE. A ring 40 has a groove or reservoir 42 which is U-shaped in cross-section and faces outwardly from the central axis 44 of the ring 40. The groove or reservoir 42 is symmetrical with respect to a plane 46 at right angles to the axis 44 of the ring. A probe or brush 48 rides within the groove 42 to make contact with the metal 50 which during operation is liquid and retained within the groove or reservoir 42 by surface tension. The liquid metal 50 wets both the walls of the groove 42 and the probe 48 thereby making contact with the rotatable ring 40 and the probe 48.

The probe 48 is chamfered along the sides as indicated, for example, at 52 symmetrically with respect to the plane 46 and further symmetrically with the central axis of the probe itself which has the same shape and presents the same face in either direction of motion with respect to the liquid metal as the ring or electrode 40 rotates about its axis 44. Preferably the probe 48 has a thickness of about one-fifth the width of channel 42 and is chamfered as shown to reduce the mechanical resistance to relative motion in the liquid so that it presents a knife edge or a sharp edge in the direction of relative motion whether the motion is in one direction or the other with respect to the liquid metal as the rotor turns in one direction or the other about axis 44. Only one edge 43 is visible in the FIGURE. The slip ring device is described and claimed in U.S. Pat. application Ser. No. 708,659 of Frank D. Berkopec et al filed on the same day as this application.

In preparing the parts the slip ring 40 or if there is an assembly the slip rings and brushes such as brush 48 are first machined to final dimensions, and mounted in fixtures which shield the areas on which the sputtered sacrificial material is not required. The rings and brushes are then sputter etched, using ordinary, known techniques to remove the outer layer of the parent metal which may have become oxidized. Next the desired parts comprising the walls of the groove 42 and the part of probe 48 to be immersed in the liquid metal are sputter deposited with the protective and sacrificial material, again using common, known techniques, to a thickness necessary to insure that the parent metal oxide does not form on the parent metal. The surfaces of the parts are protected from oxidation between etching and sputter depositing while the parts are in the sputter etch/sputter deposit facility. Vacuum is maintained between the "etch" and "sputter deposit" processes.

The sacrificial material may then be removed from areas which are not to be wet by the liquid metal, if any have been deposited thereon inadvertently. This removal is accomplished with conventional equipment using clean, dry, cautious techniques.

The slip ring and brush areas that are to be wet are then slightly abraded with a metal spatula of the same or similar composition as the parts to be wet while the areas are submerged in the liquid metal or while the liquid metal is flushed over the areas being abraded. Preferably several thicknesses of lint-free, slightly abrasive fibrous material are wrapped about the spatula. A cellulose tissue used in "clean rooms" has been satisfactory. The material is held taut around the rubbing edge of the spatula, and the rubbing edge is then applied to the area to be wet with a force of about ¼ pound (about 1 Newton). Abrading is a positive means of insuring liquid metal-sacrificial material contact. This is continued briefly until all of the sacrificial material in the area desired is dissolved and the area is wet by a liquid metal. In the process the liquid metal dissolves the sacrificial material and permanently wets the parent metal. In effect the deposit of the sacrificial material protects the parent metal from oxidation and when it is dissolved in the liquid metal the parent metal underneath the dissolved portion is easily and thoroughly wetted by the liquid metal.

Typical materials which may be used for the slip rings and brushes are high purity (99.0%) nickel or AISI type 304 stainless steel for the slip rings and brushes respectively, gold as the sacrificial material and gallium as the liquid metal.

The foregoing process may be used for any device requiring a wetted liquid metal contact, such as wetted relays, which exhibit low electrical contact resistance, or the like. The invention provides a simple and positive method for applying the liquid metal to the electrodes which will be relatively moving and wetting the desired portions or parts thereof. Machining processes which may result in undesired chips are eliminated. Areas to be wet may be more or less complicated and configurations are not restricted to the simple ones heretofore employed. Furthermore it is convenient to perform the process without the necessity of a vacuum chamber as it may be performed in an oxygen bearing atmosphere such as air. The sputter deposition of a protective and sacrificial layer of a soluble, slowly oxidizing metal on the areas to be wet, which sacrificial layer is thereafter dissolved by the application of a liquid metal, provides a superior method for wetting with liquid metal relatively moveable parts between which electrical contact is to be made by the intermediary of the liquid metal. The process is especially useful for slip rings to be used in space, but may also be used for relays or switches having moveable parts between which electrical contact is to be made.

What is claimed is

1. A process for preparing parts between which electrical contact is to be made comprising the steps of applying a sacrificial metal to said parts over the areas of contact and wetting said areas with a liquid metal which is a solvent for said sacrificial metal, whereby the sacrificial metal is dissolved and the liquid metal wets the areas underneath the dissolved sacrificial metal.

2. A process as claimed in claim 1 wherein said sacrificial metal is gold and said liquid metal is gallium.

3. A process for preparing parts between which electrical contact is to be made comprising the steps of applying a sacrificial metal to said parts over the areas of contact, abrading said areas, and wetting said areas with a liquid metal which is a solvent for said sacrificial metal whereby the sacrificial metal is dissolved and the liquid metal wets the areas underneath the dissolved sacrificial metal.

4. The process as claimed in claim 3, wherein said sacrificial metal is applied by sputter deposition.

5. The process as claimed in claim 3, wherein said abrading is performed at the same time as said wetting of said areas.

6. A process for preparing a slip ring comprising a channel and a probe between which electrical contact is to be made by the intermediary of a liquid metal comprising the steps of removing any oxide from the areas of said channel and said probe between which said contact is to be made, covering said oxide-free areas with a sacrificial metal, applying liquid metal to said channel wherein the liquid metal when liquid is retained by surface tension and to said probe over the said sacrificial metal-covered areas, thereby to dissolve the sacrificial metal in said liquid metal and wet with said liquid metal the said areas.

7. A process as claimed in claim 6, said ring and said probe consisting essentially of a metal not readily oxidized, said sacrificial metal consisting essentially of gold, and said liquid metal consisting essentially of gallium.

* * * * *